US008869776B2

(12) United States Patent
Yamane et al.

(10) Patent No.: US 8,869,776 B2
(45) Date of Patent: Oct. 28, 2014

(54) AUXILIARY DEVICE MOUNTING STRUCTURE FOR AN INTERNAL COMBUSTION ENGINE

(71) Applicant: Honda Motor Co., Ltd., Tokyo (JP)

(72) Inventors: Kaduto Yamane, Utsunomiya (JP); Masayuki Takahashi, Dublin, OH (US); Yuya Kasajima, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 23 days.

(21) Appl. No.: 13/679,018

(22) Filed: Nov. 16, 2012

(65) Prior Publication Data

US 2013/0133598 A1 May 30, 2013

(30) Foreign Application Priority Data

Nov. 25, 2011 (JP) ..... 2011-257051
Nov. 25, 2011 (JP) ..... 2011-257054
Nov. 25, 2011 (JP) ..... 2011-257058

(51) Int. Cl.
*F02M 37/04* (2006.01)
*F01L 1/34* (2006.01)

(52) U.S. Cl.
CPC ..... *F01L 1/34* (2013.01)
USPC ..... 123/509; 123/90.38; 123/195 R; 123/198 C; 123/90.33

(58) Field of Classification Search
USPC ..... 123/90.33, 90.34, 508, 509, 196, 90.6, 123/90.12, 90.38, 195 R, 195 C, 196 M, 123/198 C
See application file for complete search history.

(56) References Cited

U.S. PATENT DOCUMENTS 4,693,138 A * 9/1987 Hughes et al. ..... 74/567
4,917,052 A * 4/1990 Eguchi et al. ..... 123/41.47
5,984,650 A * 11/1999 Okubo et al. ..... 417/470

FOREIGN PATENT DOCUMENTS

JP 2-13128 B2 4/1990
JP 11-324846 A 11/1999
JP 2003-184688 A 7/2003
JP 2005-113731 A 4/2005

* cited by examiner

*Primary Examiner* — Kenneth Bomberg
*Assistant Examiner* — Wesley Harris
(74) *Attorney, Agent, or Firm* — Squire Patton Boggs (US) LLP

(57) ABSTRACT

In an auxiliary device mounting structure for mounting an auxiliary device (4) on a cylinder head (2), the auxiliary device such as a fuel injection pump is provided with a lower housing (42) attached to the cylinder head, and the upper housing (43) supporting the auxiliary device and attached to the lower housing so as to jointly form a housing chamber (48). An extension (51) of a camshaft (37) extends into the housing chamber, and is fitted with a cam (61) for actuating a plunger (86) of the auxiliary device. A radial bearing (53, 56) for the camshaft extension is integrally formed on the first housing at a position located more inward than the axial end of the cylinder head so that the cylinder head is not required to be formed with an axial extension, and is enabled to support the auxiliary device and a bearing for the camshaft extension in a highly stable manner.

16 Claims, 13 Drawing Sheets

AUXILIARY DEVICE MOUNTING STRUCTURE FOR AN INTERNAL COMBUSTION ENGINE

TECHNICAL FIELD

The present invention relates to an auxiliary device mounting structure for an internal combustion engine, and in particular to an auxiliary device mounting structure for mounting an auxiliary device actuated by a cam formed on a camshaft extension, on a cylinder head.

BACKGROUND OF THE INVENTION

An internal combustion engine is often fitted with an auxiliary device such as a fuel injection pump for supplying pressurized fuel to fuel injectors and a supply pump for supplying pressurized fuel to a common rail in the case of a diesel engine. See JP2003-184688A and JP 11-324846A, for instance.

In the prior invention disclosed in JP 11-324846A, the cylinder head 3 is formed with an axial extension 3b at an axial end thereof, and a fuel pump 40 is attached to an axial end of the cylinder head extension in coaxial relationship with the camshaft. The free end 11f of the camshaft 11 engages a drive input end 40f of the fuel pump 40 via a shaft coupler which appears to accommodate any misalignment that may exist between the cam shaft and the drive input end of the fuel pump.

JP2003-184688A discloses a similar arrangement. In FIG. 6 of JP2003-184688A illustrating prior art, the cylinder head is provided with an axial extension that is provided with a pair of bearings 8 and 9 which rotatably support an extension 4 of the exhaust camshaft 3. The camshaft extension 4 is provided with a cam 5 in a part intermediate between the two bearings to actuate a fuel pump attached to a lateral side of the cylinder head extension. In the prior invention disclosed in FIG. 1, the cylinder head extension is provided with only one bearing, and the part of the camshaft extending beyond this bearing is formed with a cam for actuating a fuel pump which is also located on a lateral side of the cylinder head extension.

The fuel pump requires a significant input torque for the actuation thereof, and the camshaft is subjected to a significant load. Furthermore, the fuel pump has a significant weight so that the part of the cylinder head supporting the fuel pump is subjected to a significant load in addition to the reaction to the input torque applied to the fuel pump. Therefore, in the prior inventions, the cylinder head was provided with an integral axial extension for firmly supporting the bearing or bearings for supporting the camshaft extension or the shaft formed with the cam for actuating the fuel pump and coupled to the camshaft.

However, providing an axial extension to the cylinder head not only increases the overall size of the engine but also complicates the manufacturing process of the cylinder head. When the fuel pump and the bearing for the camshaft extension are supported by the cylinder head via a separate member which may extend axially beyond the axial end of the cylinder head, some difficulty arises in maintaining the separate member to be firmly attached to the cylinder head. If a gap is created in the interface between the separate member and the cylinder head, the bearing for the camshaft extension may be subjected to an undue loading which could lead to a premature wear of the bearing or the journal of the extension supported by the bearing. Also, such a loading could cause vibrations and noises.

When the fuel pump is provided with a plunger as a drive input member for the actuation thereof by a cam formed on the camshaft or the extension thereof, the cam that is formed on the camshaft or the extension thereof is required to be lubricated at the surface engaging the plunger. Also, the plunger is required to be lubricated with respect to a plunger guide hole which is provided in the housing of the fuel pump. The camshaft is typically provided with an axial oil passage, but a special arrangement is required to feed the lubricating oil from the axial passage of the camshaft to the fuel pump.

JP2005-113731 discloses an invention where an extension of a camshaft extends in the manner of a cantilever from an axial end of the cylinder head, and is provided with a cam for actuating the plunger of a fuel pump. The housing of the fuel pump is directly attached to an axial end of the cylinder head. The bearing adjacent to the camshaft extension is lubricated by the lubricating oil supplied from the axial passage of the camshaft, and the lubricating oil released from this bearing is sprayed onto the surface of the cam that actuates the plunger of the cylinder head.

However, only a part of the lubricating oil sprayed from an opening in the bearing would be able to reach the surface of the cam for actuating the fuel pump, and the efficiency of lubrication may not be very high. In particular, the lubricating oil is directed to a side face of the cam, and the peripheral surface of the cam which requires lubrication may not receive any significant amount of lubricating oil. Also, no arrangement is made for the lubrication of the plunger with respect to the plunger guide hole.

In the cylinder head of an engine, a blow-by gas passage is often internally formed so that the need for external piping may be avoided. However, when a fuel pump is incorporated in the cylinder head, there may be some difficulty in forming an internal blow-by gas passage without interfering with the presence of the fuel pump.

BRIEF SUMMARY OF THE INVENTION

In view of such problems of the prior art, a primary object of the present invention is to provide an auxiliary device mounting structure for mounting an auxiliary device actuated by a cam formed on a camshaft extension on a cylinder head which does not require the cylinder head to be formed with an axial extension, and is capable of supporting the auxiliary device and a bearing for the camshaft extension in a highly stable manner.

A second object of the present invention is to provide an auxiliary device mounting structure for mounting an auxiliary device actuated by a cam formed on a camshaft extension on a cylinder head which is provided with a favorable arrangement for lubricating a drive input member such as a plunger of the auxiliary device which is actuated by the cam.

A third object of the present invention is to provide an auxiliary device mounting structure for mounting an auxiliary device actuated by a cam formed on a camshaft extension on a cylinder head in which an internal blow-by gas passage is formed within the cylinder head and the housing of the auxiliary device, and does not require external piping for conducting blow-by gas passage.

The present invention accomplishes such objects by providing an auxiliary device mounting structure for an internal combustion engine, comprising: a cylinder head defining a valve chamber in cooperation with a head cover; a camshaft rotatably supported by the cylinder head inside the valve chamber and having a coaxial and integral extension at an axial end thereof, the extension being formed with a radial cam; a first housing attached to the cylinder head, and defining a part of a housing chamber receiving the extension of the camshaft; a second housing attached to the first housing and defining a remaining part of the housing chamber; an auxiliary device supported by the second housing and provided with a plunger configured to be actuated by the radial cam of the extension; and at least one radial bearing integrally formed on the first housing at a position located more inward than the axial end of the cylinder head to rotatably support the extension.

The camshaft extension is subjected to a radial force as a reaction to the actuation of the plunger, but this reaction is avoided from acting upon the first housing in the direction to urge the first housing away from the cylinder head. Therefore, the attachment between the first housing and the cylinder head is maintained in a stable condition, and a creation of a gap between the first housing and the cylinder head can be favorably avoided.

According to this arrangement, the camshaft extension may include a part that extends axially beyond an axial end of the cylinder head in the manner of a cantilever without causing any undue force to be applied to the lower housing in the direction to urge the first housing away from the cylinder head. Thereby, the cylinder head is not required to be provided with an axial extension which could complicate the manufacturing of the cylinder head, and cause an undesired protrusion from the cylinder head that may interfere with other component parts.

When two radial bearings are integrally formed on the first housing to rotatably support the camshaft extension, the load on the camshaft extension caused by the actuation of the plunger can be more favorably supported, and is prevented from interfering with the operation of the valve cams on the camshaft via a bending deformation of the camshaft. The aforementioned advantages can be gained in this case also if both of the radial bearings are located more inward than the axial end of the cylinder head.

According to a certain aspect of the present invention, a part of the extension located between the two bearings is provided with a thrust plate, the thrust plate being provided with a thrust bearing surface that cooperates with an opposing thrust bearing surface formed in a part of the first housing. Thereby, the space between the two radial bearings which is otherwise wasted can be utilized in an advantageous manner, and this contributes to a compact design of the first housing. Preferably, the opposing thrust bearing surface of the first housing is formed in a thrust plate receiving groove formed in the first housing. Thereby, the thrust plate can be favorably lubricated by the oil available in the lower housing.

Preferably, the thrust plate is provided with at least one projection, and the second housing is provided with a sensor for detecting the projection. Thereby, the thrust plate can be used also as a pulser plate for detecting the rotational angle of the camshaft, and the number of components can be reduced. In particular, the thrust plate is typically provided with a high stiffness, and this contributes to an accurate detection of the rotational angle of the camshaft.

According to another aspect of the present invention, the first housing is provided with an oil groove that conducts lubricating oil released from at least one of the two radial bearings so that the oil collected in the first housing can be used for lubricating other parts in and adjacent to the lower housing.

According to a particularly preferred embodiment of the present invention, the camshaft consists of an exhaust camshaft, and an intake camshaft is rotatably supported by the cylinder head within the valve chamber in parallel with the exhaust camshaft; and wherein the first housing is additionally provided with a third bearing for rotatably supporting an axial end of the intake camshaft.

Thereby, the first housing can be attached to the cylinder head substantially over the entire width thereof, and this allows the first housing to be attached to the cylinder head in a particularly secure manner.

According to yet another aspect of the present invention, the first housing is provided with an extension that supports an end of a rocker shaft associated with at least one of the intake camshaft and the exhaust camshaft. Thereby, the cylinder head is not required to be provided with a feature for supporting the end of the rocker shaft, and an extra space is created in the cylinder head that may be used for accommodating the first housing.

According to yet another aspect of the present invention, the camshaft is formed with an axial passage for conducting lubricating oil and a radial passage for supplying the lubricating oil from the axial passage to an outer circumferential surface of a journal at which the extension is supported by the at least one radial bearing, the first housing is provided with a first oil passage communicating a surface of the radial bearing supporting the journal of the camshaft extension with a surface of the first housing interfacing with the second housing, and the second housing is provided with a second oil passage communicating with the first oil passage at the interfacing surface at one end thereof and with a plunger receiving hole of the second housing slidably receiving the plunger of the auxiliary device.

Thereby, the oil supplied from the axial passage of the camshaft can be favorably utilized for lubricating the cam engagement between the radial cam and the plunger, and the sliding movement of the plunger in the plunger guide hole that may be formed in the second housing. If an outer end of the plunger is located below a base end thereof, the oil which has lubricated the plunger in the plunger guide hole can be used once again for lubricating the cam engagement between the radial cam and the plunger.

According to a particularly preferred embodiment of the present invention, the radial bearing includes a lower half integrally formed with the first housing and a bearing cap attached to the lower half, and wherein the bearing lower half is provided with a lateral extension defining a part of interface with the second housing, the first oil passage being partly formed in the lateral extension, and communicating with the second oil passage at the interface of the lateral extension. Thereby, the length of the first oil passage and hence the pressure loss of the oil in the first oil passage can be minimized. The first oil passage may include a section extending in an interface between the bearing lower half and the corresponding bearing cap so that the forming of the oil passage may be simplified.

The oil collected in the first housing can be used for lubricating other parts of the engine in an efficient manner if a bottom wall of the first housing is provided with an oil drain hole for returning the oil in the first housing to the valve chamber or to an oil pan. Preferably, the cylinder head includes an upper peripheral wall, and the first housing is attached to an upper face of the upper peripheral wall, and the drain hole communicates with the valve chamber. Thereby, the lower housing can be attached to the cylinder head at a part thereof having a relatively high stiffness, and the oil drained from the lower housing can be returned to the oil pan via the same path as the oil that is returned from the valve chamber to the oil pan.

According to a preferred embodiment of the present invention, the plunger includes an oil passage communicating an interior of the plunger support hole with an outer end of the plunger. Thereby, the oil that has lubricated the plunger in the plunger support hole can be used once again to lubricate the cam engagement of the plunger.

According to yet another aspect of the present invention, the auxiliary device mounting structure further comprises a breather case defining a breather chamber in cooperation with an outer surface of the head cover, the breather chamber directly communicating with the housing chamber which in turn communicates with the valve chamber.

Thereby, the blow-by gas can be forwarded from the valve chamber to the breather chamber via the housing chamber, and the presence of the first and second housings does not prevent the blow-by gas in the valve chamber to be forwarded to the breather chamber without requiring any complex passage system or without encountering any significant flow resistance. The blow-by gas passage system can be particularly simplified if the head cover is formed with a blow-by gas passage that communicates the breather chamber with the housing chamber via a part thereof at an interface with the second housing.

BRIEF DESCRIPTION OF THE SEVERAL VIEWS OF DRAWINGS

Now the present invention is described in the following with reference to the appended drawings, in which.

DETAILED DESCRIPTION OF THE PREFERRED EMBODIMENT

Figure 1:
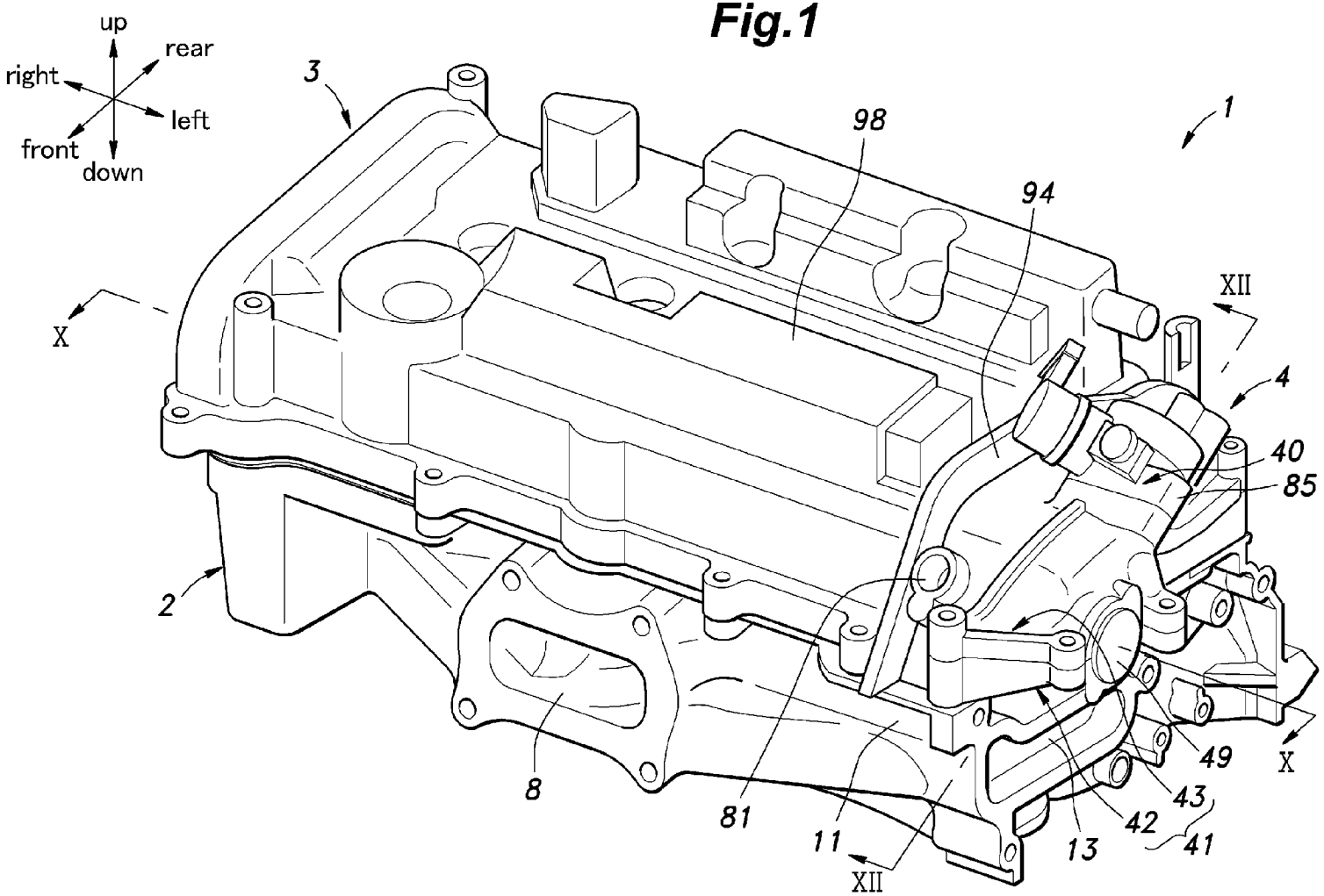
FIG. 1 is a perspective view showing an upper structure of an internal combustion engine along with a fuel injection pump attached to an upper end of a cylinder head at an axial end of the cylinder head.
Figure 2:
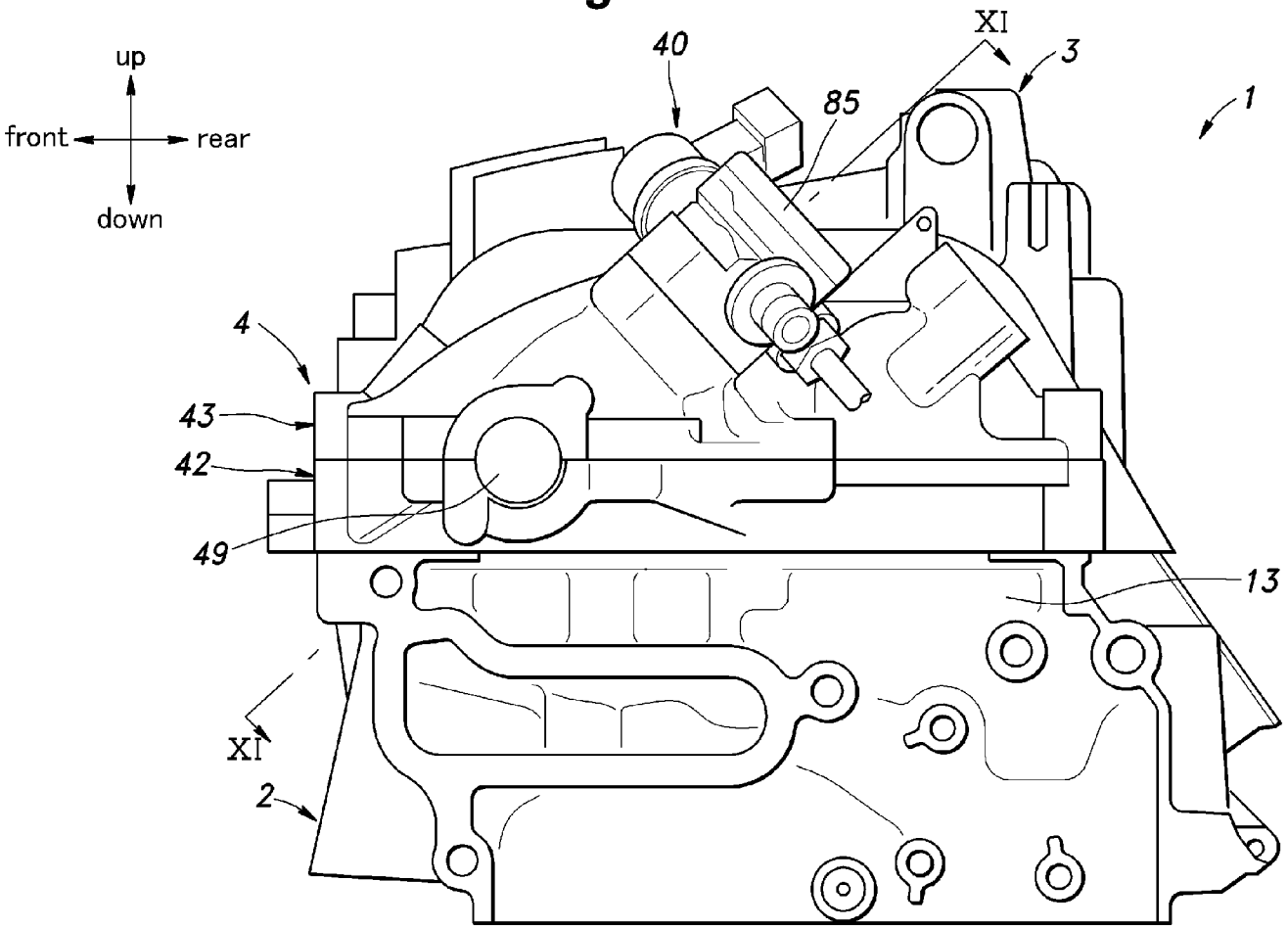
FIG. 2 is an end view of the upper structure of the internal combustion engine including the fuel injection pump.

Now the present invention is described in the following in more detail in terms of a concrete embodiment with reference to the appended drawings. In the illustrated embodiment, the invention is applied to an inline, four-cylinder, four-valve DOHC gasoline engine with direct fuel injection. The engine is laterally disposed on a vehicle not shown in the drawings, and the cylinders of the engine are disposed substantially vertically or may also be slightly tilted rearward or forward. The orientations mentioned in the following disclosure are based on this positioning of the engine although the present invention may be applicable to engines of any other orientations.

The engine 1 includes a cylinder head 2 attached to an upper face of a cylinder block (not shown in the drawings), a head over 3 attached to an upper face of the cylinder head 2 and a fuel injection pump 4 connected to both an axial end of the head cover 3 and an upper face of the cylinder head 2 such that the fuel injection pump 4 extends slightly beyond the corresponding axial end of the cylinder head 2. The fuel injection pump 4 as used herein refers to a fuel injection pump assembly including a pump main body, the housing thereof and associated component parts.

As shown in FIGS. 1 to 4, the cylinder head 2 is generally given with a rectangular shape in plan view, somewhat elongated in the axial direction, and is formed with recesses in the lower surface thereof that define combustion chambers (not shown in the drawings) in cooperation with the cylinder block. The cylinder head 2 is further formed with exhaust ports (not shown in the drawings) and intake ports 6 extending laterally on either side of the cylinder head 2 and communicating with the corresponding combustion chambers. The exhaust ports merge into an exhaust collection chamber 8 formed in a lower part of the cylinder head 2 as the exhaust ports extend away from the combustion chambers. As shown in FIG. 1, the exhaust collection chamber 8 opens our centrally on one side (front side) of the cylinder head 2 in a lower part of the cylinder head 2. The upper end of the cylinder head 2 is provided with a front peripheral wall 11, a rear peripheral wall 12, a left peripheral wall 13, a right peripheral wall 14 and a bottom wall 15 so as to define a valve chamber 16 in cooperation with the head cover 3 and the fuel injection pump 4 as will be discussed hereinafter. The upper ends of the front peripheral wall 11, the rear peripheral wall 12, the left peripheral wall 13 and the right peripheral wall 14 define a rectangular and annular attaching surface 17 for attaching thereto the head cover 3 and the fuel injection pump 4 as will be discussed hereinafter.

Figure 4:
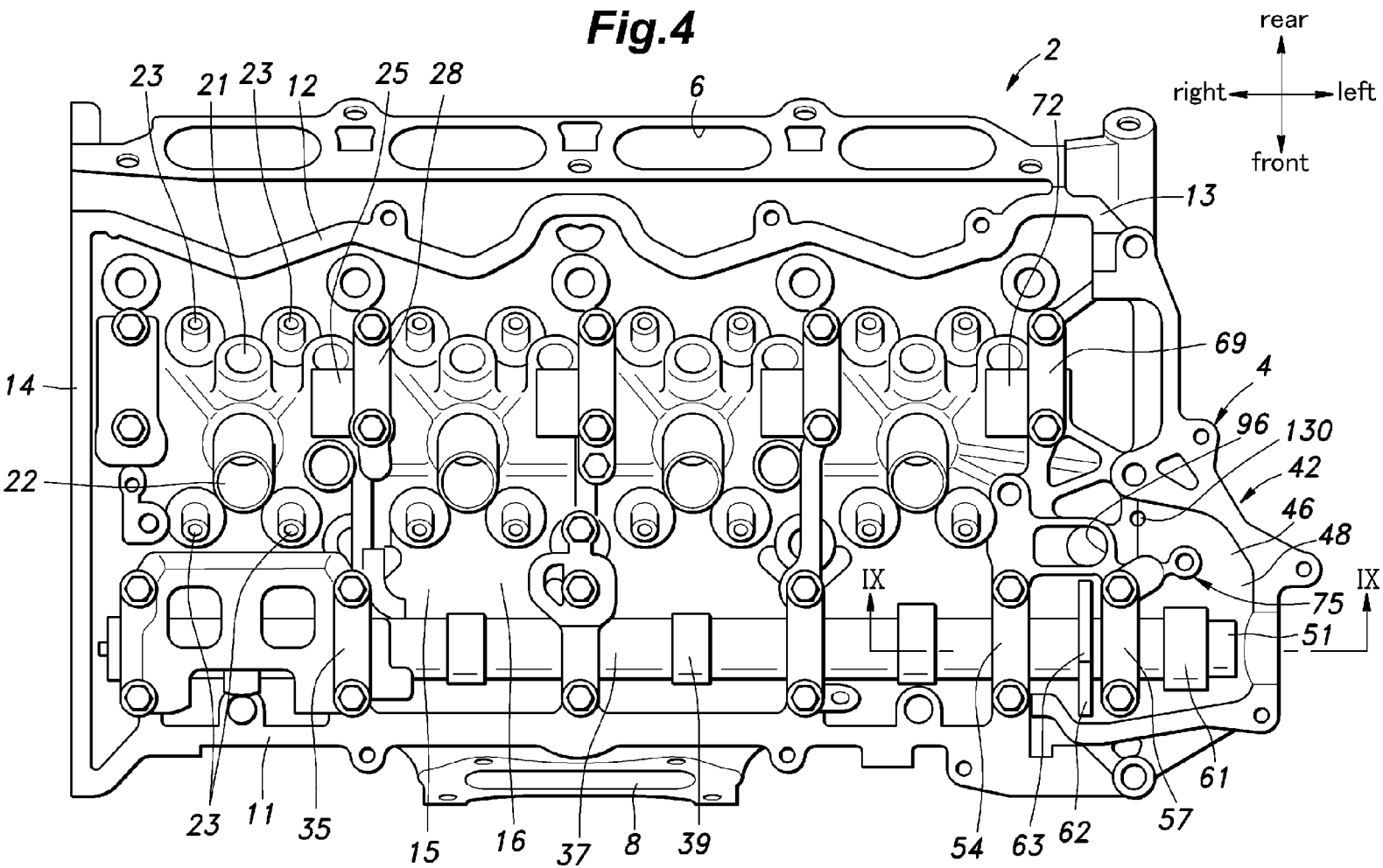
FIG. 4 is a plan view showing the upper end of the cylinder head and the lower housing.

As shown in FIG. 4, the bottom wall 15 of the cylinder head 2 is formed with injector holes 21 for receiving fuel injectors not shown in the drawings, plug holes 22 for receiving spark plugs not shown in the drawings and valve holes 23 defining valve seats and stem guide holes for intake valves and exhaust valves not shown in the drawings. These holes communicate with the corresponding combustion chambers.

Figure 3:
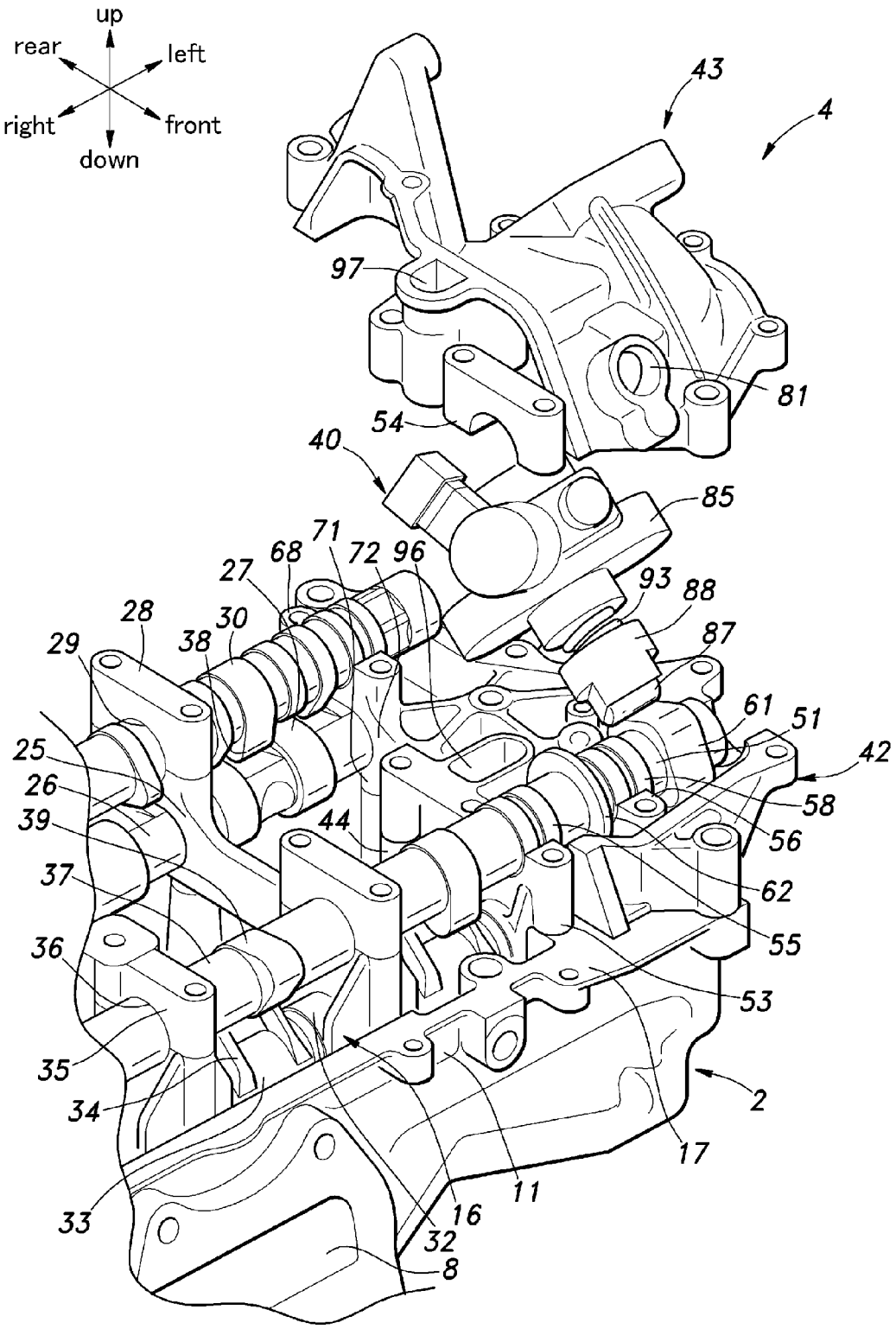
FIG. 3 is an exploded perspective view of the upper structure of the internal combustion engine including the fuel injection pump.

As shown in FIGS. 3 and 4, a plurality of bearing blocks 25 are integrally formed on the bottom wall 15 of the cylinder head 2 along one side thereof (rear side with respect to the vehicle body), each provided with a bore for receiving an intake rocker shaft 26. The rocker shaft 26 rotatably supports intake rocker arms 27 which act upon the corresponding intake valves. Each bearing block 25 defines a semi-cylindrical recess on the upper face thereof, and a corresponding bearing cap 28 also defining a semi-cylindrical recess is attached to the upper face of the bearing block 25 so as to jointly form a bearing 29 for an intake camshaft 30.

Similarly, a plurality of bearing blocks 32 are integrally formed on the bottom wall 15 of the cylinder head 2 along the other side thereof (front side with respect to the vehicle body), each provided with a bore for receiving an exhaust rocker shaft 33. The rocker shaft 33 rotatably supports exhaust rocker arms 34 which act upon the corresponding exhaust valves. Each bearing block 32 defines a semi-cylindrical recess on the upper face thereof, and a corresponding bearing cap 35 also defining a semi-cylindrical recess is attached to the upper face of the bearing block 32 so as to jointly form a bearing 36 for an exhaust camshaft 37.

The intake camshaft 30, the exhaust camshaft 37, the intake rocker shaft 26 and the exhaust rocker shaft 33 extend along the length of the cylinder head 2 (laterally with respect to the vehicle body). The intake camshaft 30 is formed with intake cams 39 for actuating the intake rocker arms 27, and the exhaust camshaft 37 is likewise formed with exhaust cams 39 for actuating the exhaust rocker arms 34. The intake camshaft 30 and the exhaust camshaft 37 are in turn actuated by a timing belt (or a chain) passed around the sprockets (not shown in the drawings) secured to the corresponding axial ends of the two camshafts 37 and the crankshaft.

Figure 8:
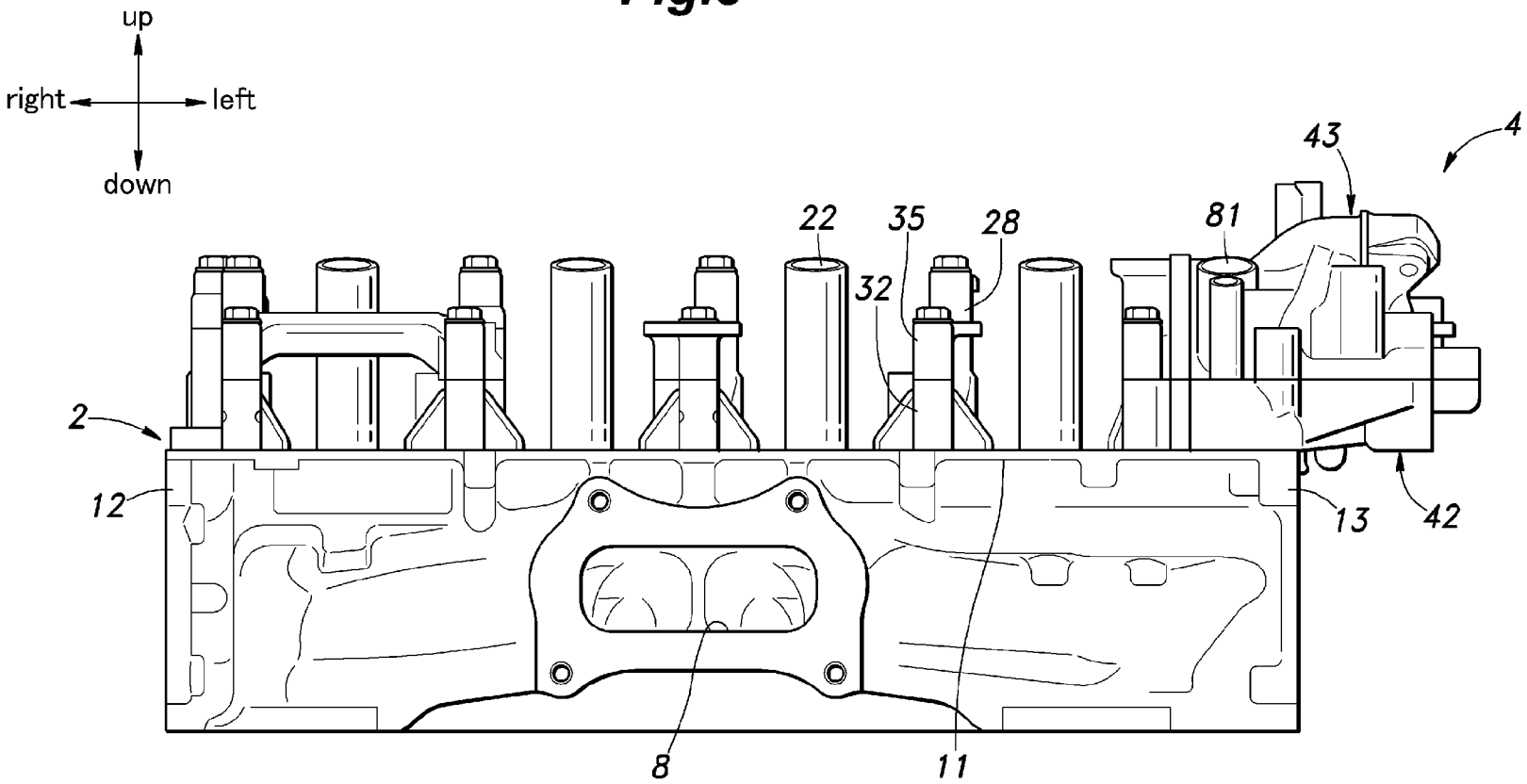
FIG. 8 is a side view of the cylinder head, the upper housing and the lower housing.

As shown in FIG. 3, the fuel injection pump 3 includes a pump main body 40 and a housing 41 supporting the pump main body 40 with respect to the cylinder head 2, and the housing 41 consists of a lower housing (first housing) 42 and an upper housing (second housing) 43 which are joined to each other at a horizontal interface (parallel to the attaching surface 17). As shown in FIGS. 3 and 8, the lower housing 42 is provided with mating faces that are attached to the attaching surface 17 of the left peripheral wall 13, the front peripheral wall 11 and the right peripheral wall 14, and a plurality of bosses 44 projecting from the left end part of the bottom wall 15, and extends leftward beyond the left peripheral wall 13 (thereby forming an overhang of the cylinder head or the engine block). The upper housing 43 covers the upper end of the lower housing 42, and is attached thereto. The cylinder head 2, the lower housing 42 and the upper housing 43 are joined to each other by threaded bolts including those passed through the upper and lower housings 42 and 43 and threaded into the cylinder head 2, and those passed through the upper housing 43 and threaded into the lower housing 42.

The lower housing 42 is provided with a lower housing recess 46 on an upper surface thereof. The upper housing 43 is provided with an upper housing recess 47 on a lower surface thereof. The lower housing 42 and the upper housing 43 jointly form a housing chamber 48 that receives a terminal end (or an extension) of the exhaust camshaft 37 therein. See FIG. 12. The housing chamber 48 opens out on either axial side thereof, and the left side (or the outward side) thereof is closed by a plug 49 fitted into an opening jointly defined by the upper and lower housings 42 and 43 while the right side (or the inward side) thereof communicates with the interior of the valve chamber 16.

As shown in FIG. 3, the exhaust camshaft 37 is integrally and coaxially formed with an extension 51 on the left end thereof, and it is this extension 51 that is primarily received in the housing chamber 48. In particular, the extension 51 extends outward (or leftward) (at least partly) beyond the left peripheral wall 13.

Figure 9:
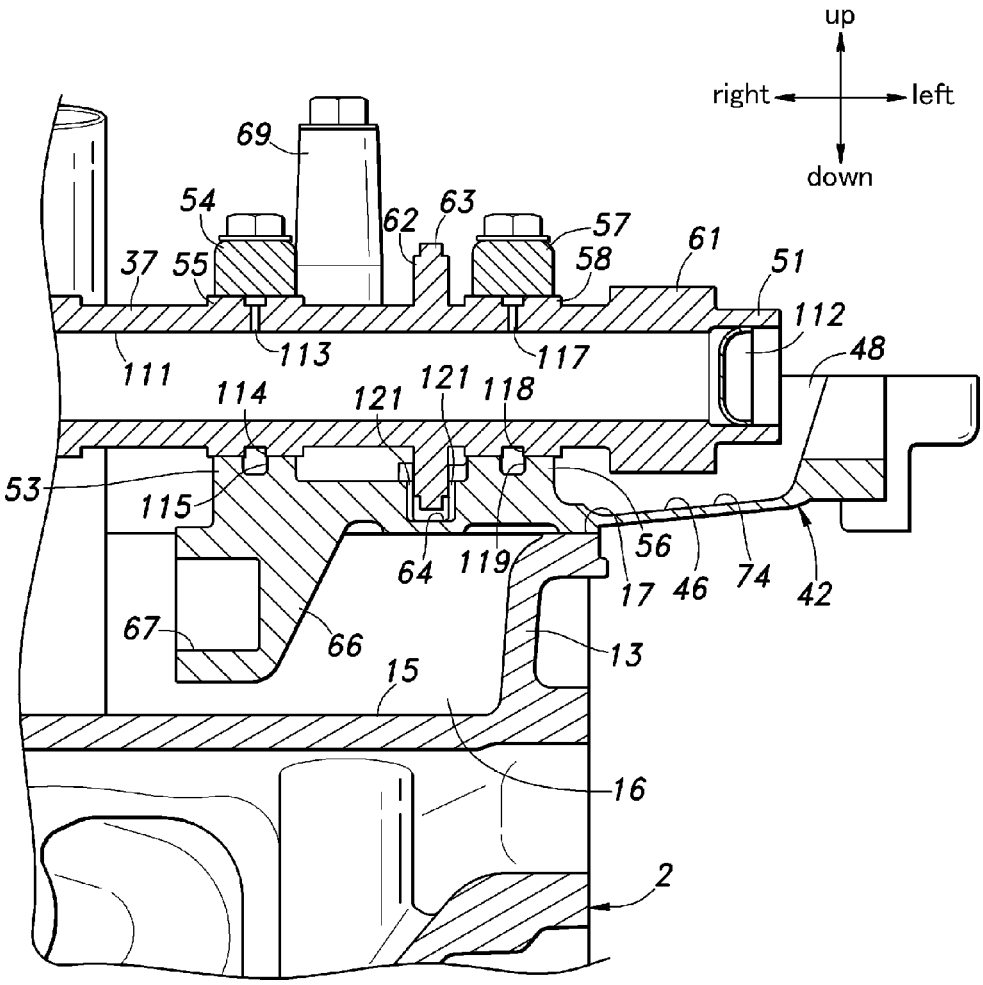
FIG. 9 is a sectional view taken along line IX-IX of FIG. 4.

As shown in FIGS. 3 and 9, the lower housing recess 46 of the lower housing 42 is integrally formed with a first bearing lower half 53 at a right end (inward end) part thereof, and a first bearing cap 54 serving as a first bearing upper half is attached to the first bearing lower half 53 by using threaded bolts so as to define a first bearing that rotatably supports a first journal 55 of the extension 51 or the left end part of the exhaust camshaft 37.

Additionally, the lower housing recess 46 of the lower housing 42 is integrally formed with a second bearing lower half 56 at a part thereof to the left of the first bearing lower half 53 along the exhaust camshaft 37 and slightly rightward of the left peripheral wall 13, and a second bearing cap 57 serving as a second bearing upper half is attached to the second bearing lower half 56 by using threaded bolts so as to define a second bearing that rotatably supports a second journal 58 of the extension 51 or the left end part of the exhaust camshaft 37. The second bearing as well as the first bearing is located above the cylinder head 2.

The part of the extension 51 to the left of the second journal 58 extends leftward (or outward) beyond the second bearing in the manner of a cantilever, and is formed with a pump drive cam (auxiliary device drive cam) 61 on the outer circumferential surface thereof for actuating the fuel injection pump 4. As shown in FIG. 9, the pump drive cam 61 is located to the left of the left peripheral wall 13. The pump drive cam 61 is rotatable within the housing chamber 48 without interfering with the wall surface of the upper housing 43 and the lower housing 42.

The part of the extension 51 located between the first journal 55 and the second journal 58 is formed with a disk-shaped thrust plate 62 extending radially therefrom. The outer peripheral surface of the thrust plate 62 is formed with a tooth (projection) or more preferably a plurality of teeth 63. The part of the lower housing 42 located between the first bearing lower half 53 and the second bearing lower half 56 is formed with a thrust plate receiving groove 64 which may be crescent-shaped so as to surround the lower edge of the thrust plate 62 with a certain clearance. The axial end surfaces (left and right surfaces) of the thrust plate 62 serve as thrust bearing surfaces for the exhaust camshaft 37 in cooperation with the corresponding side surfaces of the thrust plate receiving groove 64.

As shown in FIG. 9, the lower housing 42 is integrally provided with a lower extension 66 extending downward into the valve chamber 16 at a part thereof substantially under the first bearing lower half 53. The lower end of the lower extension 66 is located below the attaching surface 17 of the left peripheral wall 13, and terminates slightly short of the bottom wall 15. The lower extension 66 is formed with a cylindrical recess 67 facing rightward for receiving a corresponding terminal end of the exhaust rocker shaft 33 in a rotationally fast manner.

Figure 5:
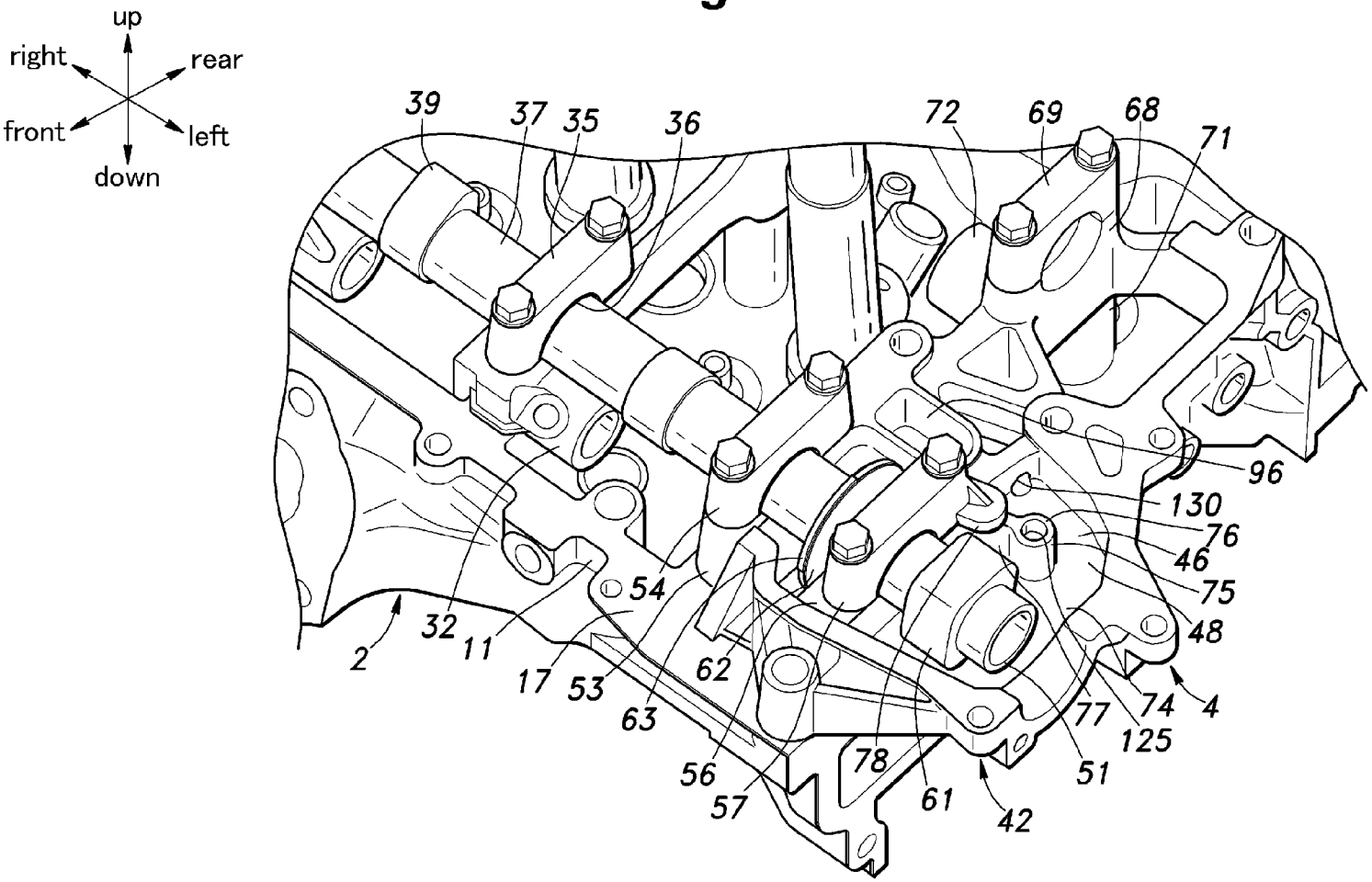
FIG. 5 is a fragmentary perspective view of the upper end of the cylinder head and the lower housing.
Figure 6:
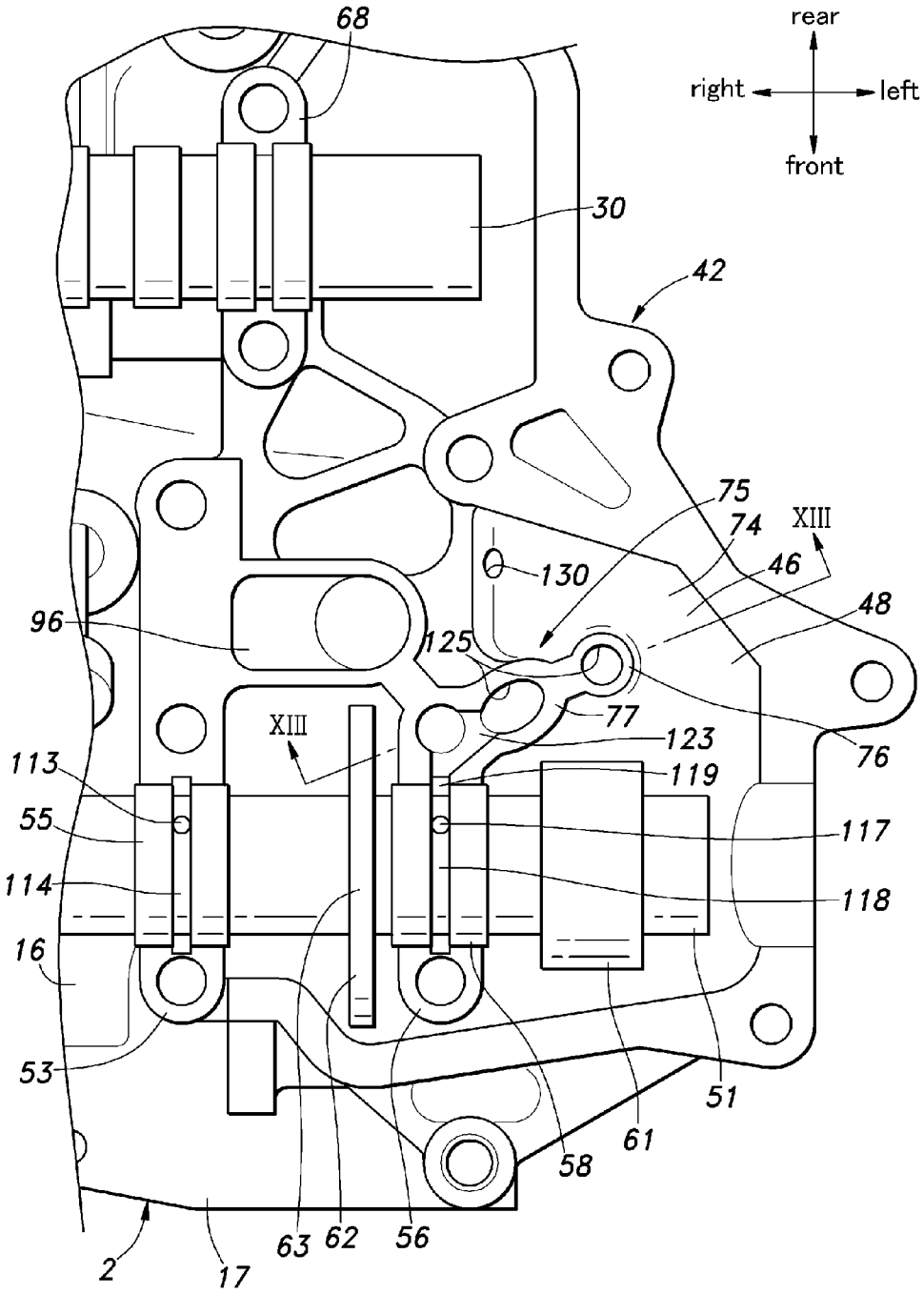
FIG. 6 is a fragmentary plan view of the upper end of the cylinder head and the lower housing.

As shown in FIGS. 5 and 6, the lower housing recess 46 of the lower housing 42 is integrally formed with a third bearing lower half 68 at a right end (inward end) part thereof corresponding to the intake camshaft 30, and a third bearing cap 69 serving as a third bearing upper half is attached to the third bearing lower half 68 by using threaded bolts so as to define a third bearing that rotatably supports the intake camshaft 30. Additionally, the lower housing 42 is integrally provided with a lower extension 71 extending downward into the valve chamber 16 at a part thereof substantially under the third bearing lower half 68. The lower end of the lower extension 71 is located below the attaching surface 17 of the left peripheral wall 13, and terminates slightly short of the bottom wall 15. The lower extension 71 is formed with a cylindrical recess 72 facing rightward for receiving a corresponding terminal end of the intake rocker shaft 26 in a rotationally fast manner.

As shown in FIGS. 5 and 6, on the bottom surface 74 of the lower housing recess 46, a land portion 75 extends obliquely leftward and rearward from a side of the second bearing lower half 56 to a lateral side of the pump drive cam 61. The upper surface of the land portion 75 is flush with the interface between the second bearing lower half 56 and the second bearing cap 57 (and with the interface between the lower housing 42 and the upper housing 43), and a terminal end 76 of the land portion 75 is configured to be attached to the opposing attaching surface of the upper housing 43. The base end 77 of the land portion 75 is covered by a second bearing cap extension 78 extending from the second bearing cap 57.

As shown in FIGS. 1 and 3, the part of the upper housing 43 corresponding to the thrust plate 62 is formed with a through hole or a sensor hole 81 for fixedly receiving a rotation sensor (not shown in the drawings) for detecting the teeth 63 formed around the thrust plate 62 to detect the angular position and the rotational speed of the exhaust camshaft 37. Thus, the thrust plate 62 provided with the teeth 63 additionally serves as a pulser plate for causing a pulse signal corresponding to the rotation of the exhaust camshaft 37 to be obtained.

Figure 11:
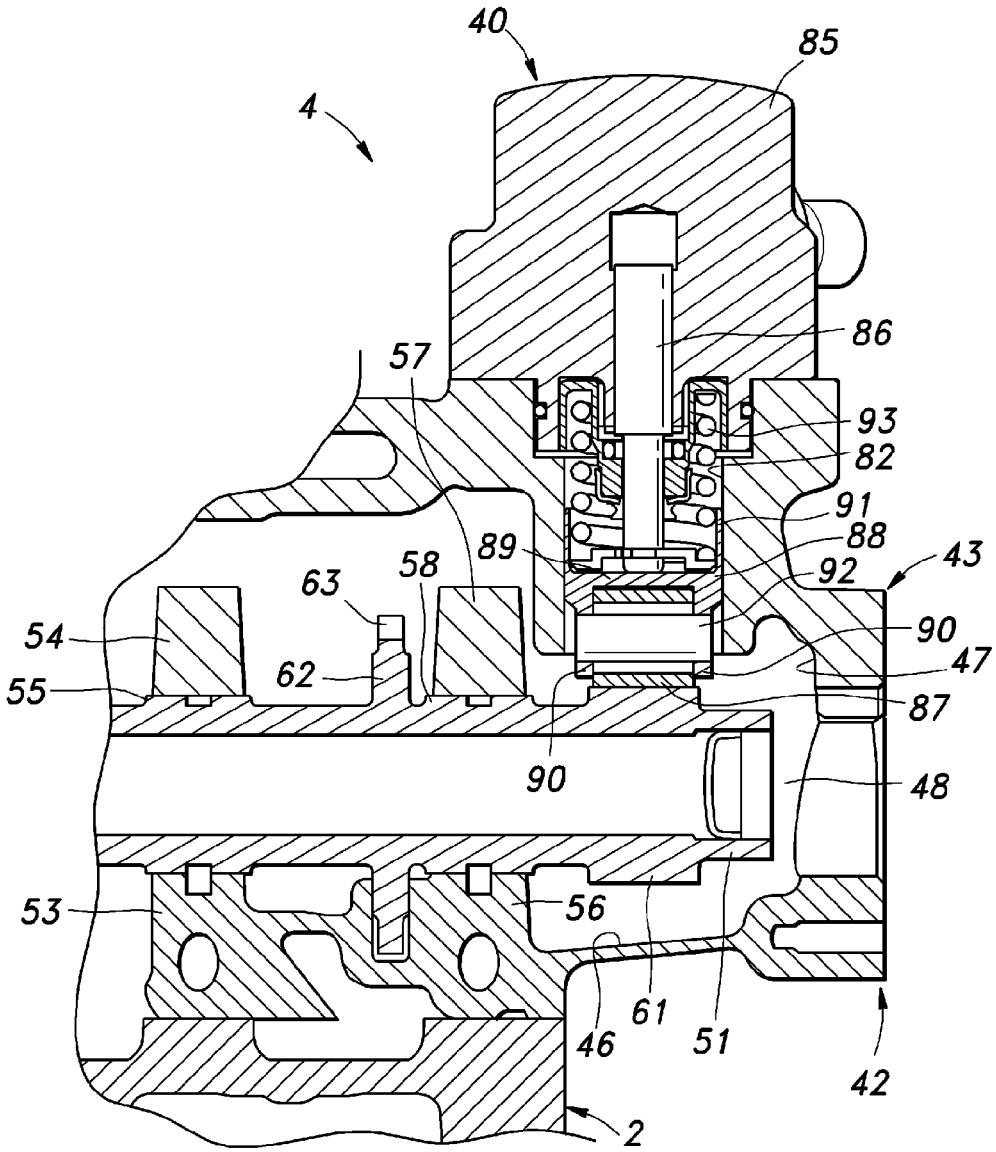
FIG. 11 is a sectional view taken along line XI-XI of FIG. 2.
Figure 12:
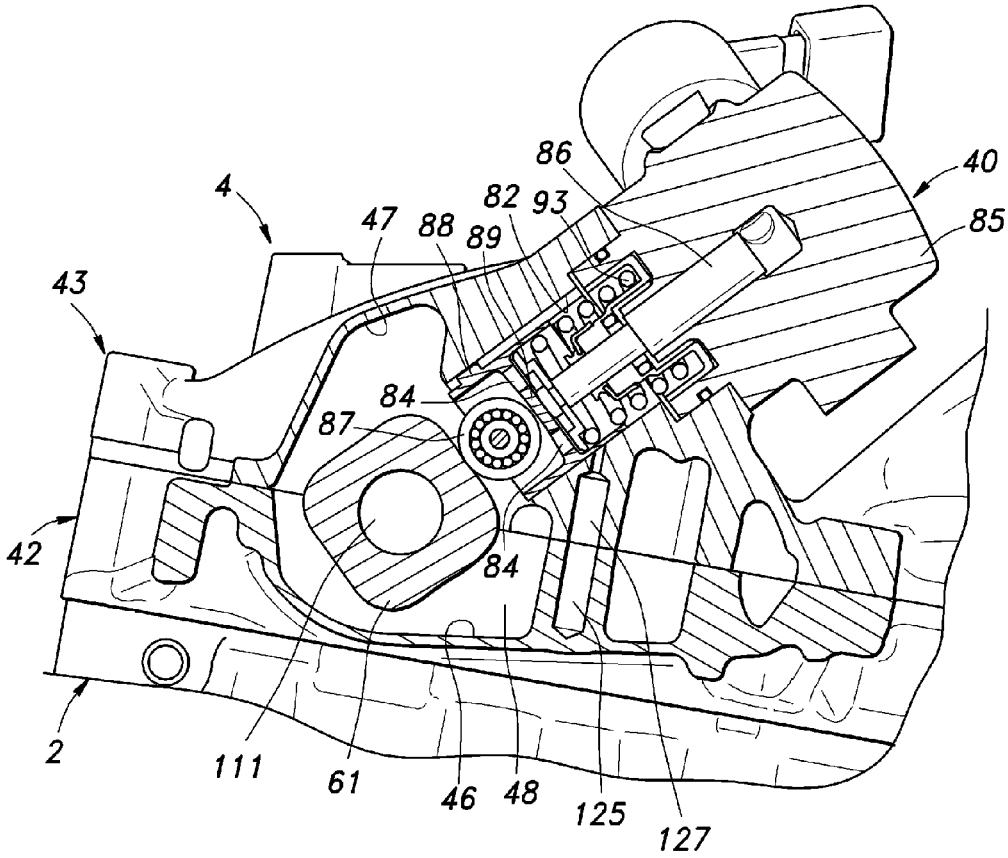
FIG. 12 is a sectional view taken along line XII-XII of FIG. 1.

As shown in FIGS. 11 and 12, the upper housing 43 is formed with a through hole or a plunger supporting hole 82 having a circular cross section. The axial line of the plunger supporting hole 82 extends in a radial direction with respect to the axial center of the extension 51 of the exhaust camshaft 37, and is somewhat tilted with respect to the horizontal plane. In the illustrated embodiment, the axial line of the plunger supporting hole 82 is given with a 45 degree tilt in the fore and aft direction (or around the axial line of the extension 51). By thus tiling the injector pump 4, the overall height of the engine 1 can be minimized. The outer (upper) end of the plunger supporting hole 82 is given with a greater inner diameter, and is coaxial with the remaining part of the plunger supporting hole 82.

As shown in FIGS. 11 and 12, the pump main body 40 consists of a per se known plunger pump, and includes a pump casing 85 formed with a fuel passage and a plunger 86 configured to reciprocate axially into and out of the pump casing 85. The pump main body 40 draws fuel into the fuel passage in the pump casing 85 when the plunger 86 is pulled out of the pump casing 85, and expels fuel under pressure out of the pump casing 85 when the plunger 86 is pushed into the pump casing 85.

The outer end of the plunger 86 is fitted with a roller holder 88 that rotatably supports a roller 87. The roller holder 88 includes a disk-shaped base plate 89 engaging the outer end of the plunger 86, a pair of support legs 90 projecting outward from either side of the base plate 89 and a cylindrical skirt 91 extending inward from the peripheral part of the base plate 89. A support shaft 92 extends between the support legs 90, and the roller 87 is rotatably supported by the support shaft 92. The base plate 89 is formed with a plurality of oil holes 84 across the thickness thereof, and a compression coil spring 93 is interposed between the base plate 89 and the pump casing 85 to urge the plunger 86 out of the pump casing 85.

The pump housing 85 is attached to the upper housing 43 with the plunger 86 received in the plunger support hole 82 via the roller holder 88 and a part of the pump casing 85 fitted in an adjoining enlarged end of the plunger support hole 82. The plunger support hole 82 receiving the plunger 86 via the roller holder 88 extends in an oblique direction (by being angled around the axial center line of the extension 51), and the roller 87 is located at the lowermost end of the plunger 86. The skirt 91 of the roller holder 88 slides along the inner peripheral surface of the plunger support hole 82, and a part of the roller holder 88 and the roller 87 are located in the housing chamber 48 such that the roller 87 engages the pump drive cam 61. The plunger support hole 82 is formed with an axially extending guide groove, and the outer circumferential surface of the skirt 91 is formed with a guide projection that is received in the guide groove so that the angular position of the roller holder 88 remains fixed with respect to the plunger support hole 82 as the guide projection slides along the guide groove. As the exhaust camshaft 37 rotates, the pump drive cam 61 causes the plunger 86 to reciprocate into and out of the pump casing 85 such that the pump main body 40 expels fuel under pressure. The fuel injection pump 4 is thus actuated as the exhaust camshaft 47 rotates.

As shown in FIG. 1, the head cover 3 extends from the right end to the left end of the valve chamber 16, and the left edge 94 of the head cover 3 slightly overlaps with the upper surface of the upper housing 43 such that the left end of the valve chamber 16 communicates with the housing chamber 48 defined in the housing 41 located to the left of the head cover 3 while the remaining part of the valve chamber 16 is enclosed by the head cover 3 from above. More specifically, the interface between the left edge 94 of the head cover 3 and the right edge of the upper surface of the upper housing 43 is sealed by liquid seal interposed between them.

Figure 10:
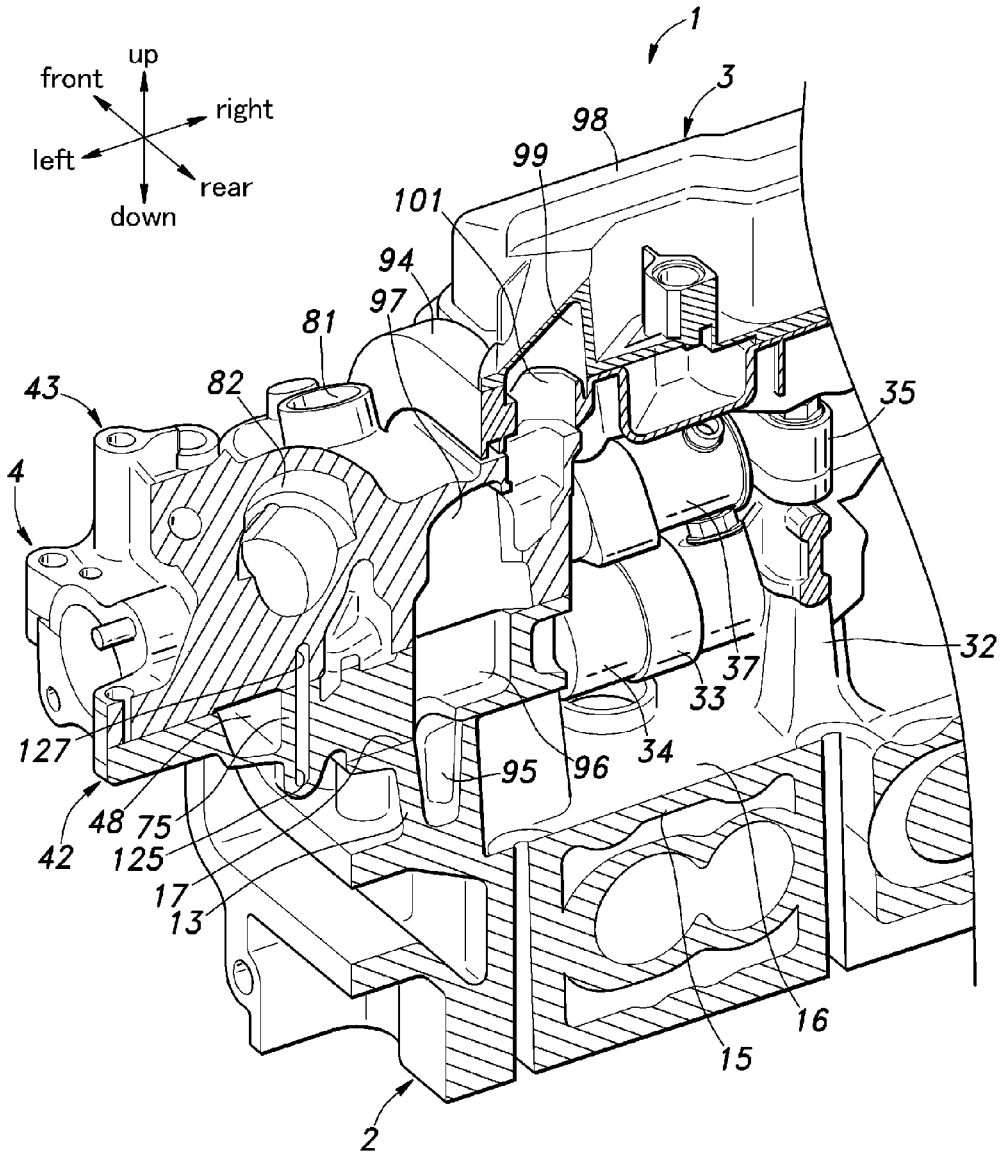
FIG. 10 is a sectional view taken along line X-X of FIG. 1.

As shown in FIG. 10, the left end part of the cylinder head 2 is formed with a blow-by gas passage 95 which communicates with a blow-by gas passage (not shown in the drawings) formed in the crankcase. The blow-by gas passage of the cylinder block communicates with a crankcase chamber (not shown in the drawings) formed in a lower part of the crankcase at one end (the lower end thereof) and opens out at the upper face thereof or at the interface with the cylinder head 2 at the other end (the upper end thereof). The blow-by gas passage 95 of the cylinder head 2 extends vertically within the left peripheral wall 13, and communicates with the upper end of the blow-by gas passage of the cylinder block at the lower end thereof and opens out at the upper face thereof or the attaching surface 17 at the upper end thereof.

The lower housing 42 is formed with a lower blow-by gas passage 96 which extends vertically, and communicates with the blow-by gas passage 95 of the cylinder head 2 at the lower end thereof (at the interface 17) and opens out at the upper face thereof (or the interface with the upper housing 43). As shown in FIGS. 3 to 6, the lower blow-by gas passage 96 is located to the right of the pump drive cam 61 and between the first bearing lower half 53 and the second bearing lower half 56 in terms of lateral positional relationship. The lower blow-by gas passage 96 is also located between the exhaust camshaft 37 and the intake camshaft 30 in terms of fore and aft positional relationship. In particular, the upper end of the lower blow-by gas passage 96 is located behind the thrust plate 62 in a non-overlapping relationship in plan view.

As shown in FIG. 10, the upper housing 43 is provided with an upper blow-by gas passage 97 extending vertically therein, and communicates with the upper end of the lower blow-by gas passage 96 at the lower end thereof (at the interface with the lower housing 42) and opens out into a part of the valve chamber 16 which is adjacent to the part covered by the left edge 94 of the head cover 3 at the upper end thereof.

Referring to FIG. 10, the breather case 98 extending in the lateral direction and having an open bottom end is attached to the front end of the head cover 3, and defines a breather chamber (separator chamber) 99 in cooperation with the opposing upper face of the head cover 3. A plurality of baffle plates (not shown in the drawings) extend from the inner surface of the breather case 98 for the purpose of separating oil mist from the blow-by gas that passes through the breather chamber 99 as will be described hereinafter. A blow-by gas passage 101 is formed in the left end wall 94 of the head cover 2, and communicates with the upper blow-by gas passage 97 at one end thereof (at the interface with the upper housing 43) and with the breather chamber 99 at the other end via an opening in the part of the head cover 3 covered by the breather case 98. The blow-by gas originating from the crankcase chamber thus passes through the blow-by passages of the crankcase, the blow-by passage 95 of the cylinder head 2, the blow-by passage 96 of the lower housing 42, the blow-by passage 97 of the upper housing 43 and the blow-by gas passage 101 of the head cover 3, in that order, and is finally introduced into the breather chamber 99. The blow-by gas from which oil mist has been separated in the breather chamber 99 is forwarded, via a PCV valve (not shown in the drawings), to a part of the intake system communicating with the intake ports 6.

Figure 7:
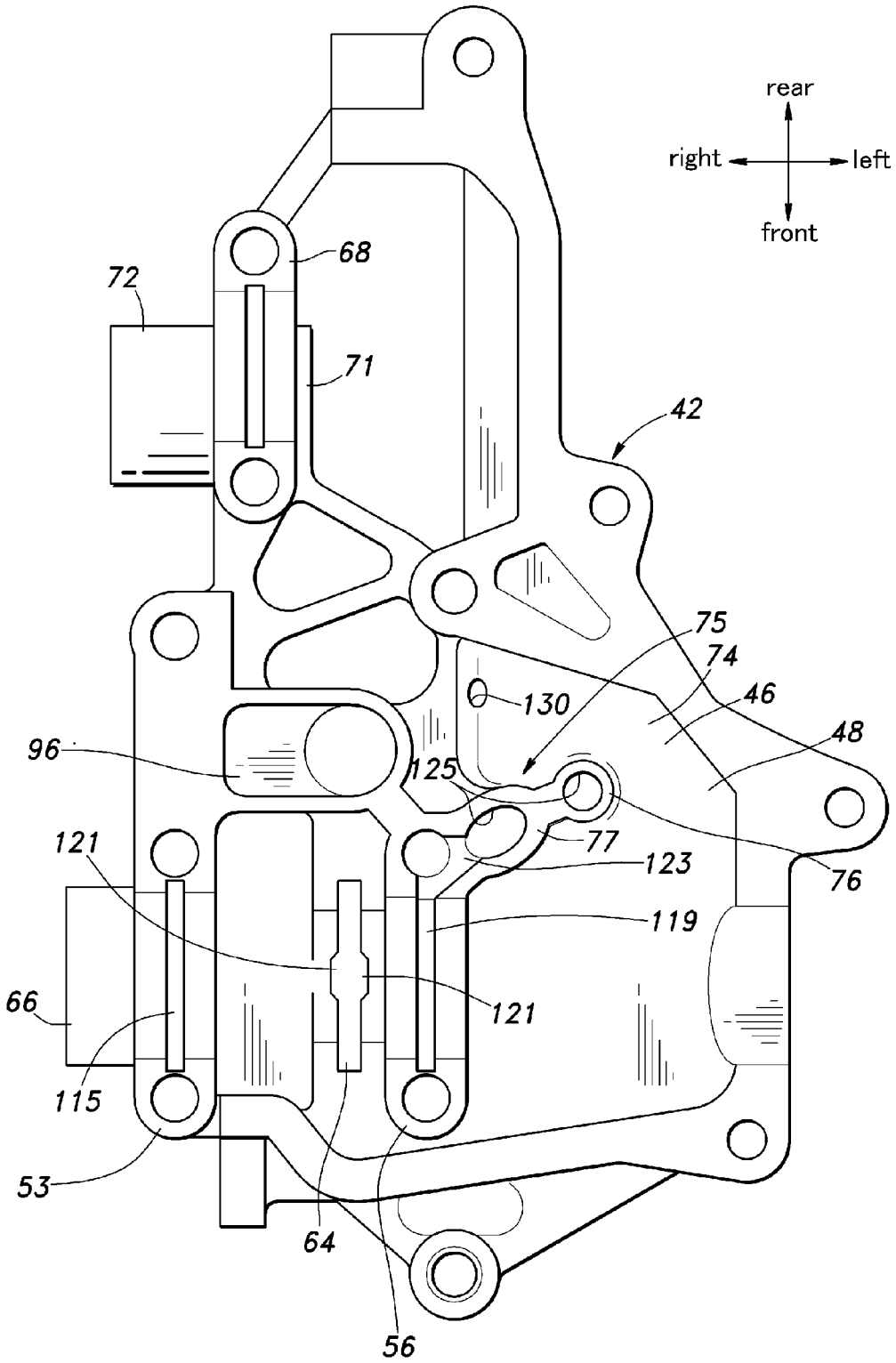
FIG. 7 is an enlarged plan view of the lower housing.

The lubricating arrangement for the oil injection pump 4 is now described in the following. As shown in FIG. 9, the exhaust camshaft 37 and the extension 51 thereof are internally formed with an exhaust camshaft oil passage 111 extending in the axial direction. The left end of the axial exhaust camshaft oil passage 111 is closed by a plug 112 at the terminal end of the extension 51. The first journal 55 is formed with a first communication passage 113 extending from the exhaust camshaft oil passage 111 to an annular first journal oil groove 114 extending along the outer circumferential surface of the first journal 55. As shown in FIGS. 7 and 9, the bearing surface of the first bearing lower half 53 is formed with an annular oil groove 115 so as to oppose the oil groove 114 of the first journal 55.

As shown in FIG. 9, the second journal 58 is formed with a second communication passage 117 extending from the exhaust camshaft oil passage 111 to an annular second journal oil groove 118 extending along the outer circumferential surface of the second journal 58. As shown in FIGS. 7 and 9, the bearing surface of the second bearing lower half 56 is formed with an annular oil groove 119 so as to oppose the oil groove 118 of the second journal 58.

As shown in FIGS. 7 and 9, the wall surfaces of the thrust plate receiving groove 64 opposing the thrust plate 62 are each formed with a vertically (or radially extending) oil groove 121, and the two oil grooves 121 communicate with each other at the bottom end of the thrust plate receiving groove 64.

Figure 13:
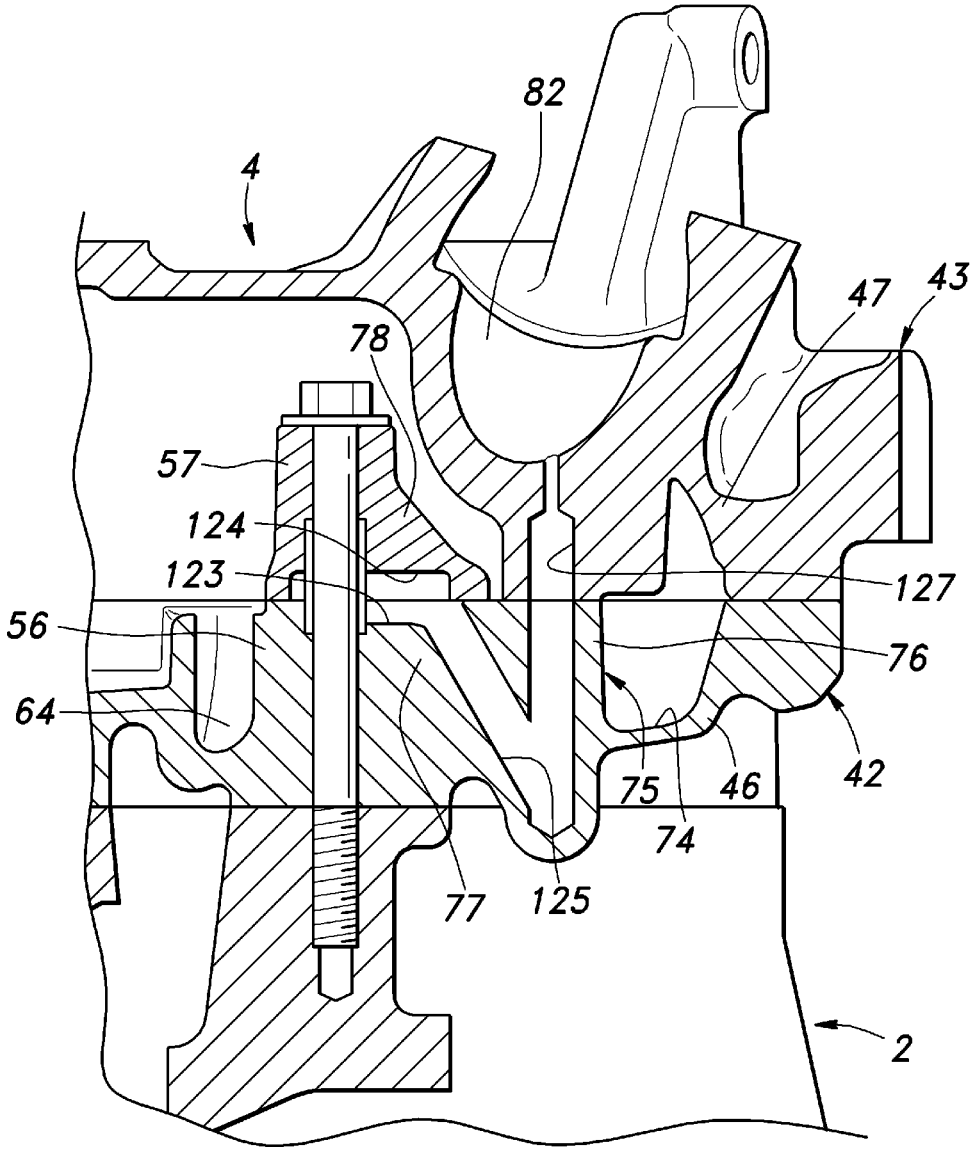
FIG. 13 is a sectional view taken along line XIII-XIII of FIG. 6.

As shown in FIG. 6, in the interface between the second bearing lower half 56 and the second bearing cap 57 is formed an oil groove 123 that communicates with the oil groove 119 of the second bearing lower half at one end thereof and with the base end 77 of the land portion 75 at the other end thereof. As shown in FIG. 13, in the interface between the second bearing cap 57 including the second cap extension 78 and the second bearing lower half 56 including the base end 77 of the land portion 75 is formed an oil groove 124 that extends opposite to and along the oil groove 123. The oil groove 123 communicates with the oil groove 123 at the base end 77 of the land portion 75 at one end thereof, and opens out from the top surface of the terminal end 76 of the land portion 75. As shown in FIG. 13, the oil passage 125 in the land portion 75 includes a first linear section extending downward from the base end 77 to the lower part of the terminal end 76 of the land portion 75 and a second linear section extending upward from the from the lower part of the terminal end 76 of the land portion 75 to the top surface of the terminal end 76 of the land portion 75. By thus forming the oil passage 125 in the land portion 75 in a V-shaped configuration consisting of two linear sections, the forming of the oil passage 125 in the land portion 75 is facilitated.

An end of the upper housing oil passage 127 communicating with the in the land portion 75 opens out at the interface between the upper housing 43 and the terminal end 76 of the land portion 75, and the other end of the upper housing oil passage 127 opens out into the plunger support hole 82 as best shown in FIG. 13.

In this lubricating arrangement for the fuel injection pump 4, lubricating oil is supplied from a per se known oil pump (not shown in the drawings) to the exhaust camshaft oil passage 111 of the exhaust camshaft 37 via the oil passages formed in the cylinder block and the cylinder head 2. The lubricating oil supplied to the exhaust camshaft oil passage 111 is then forwarded to the outer circumferential surface of the first journal 55 via the first communication oil passage 113, the first journal oil groove 114 and the first bearing lower half oil groove 115. The lubricating oil supplied to the exhaust camshaft oil passage 111 is also forwarded to the outer circumferential surface of the second journal 58 via the second communication oil passage 117, the second journal oil groove 118 and the second bearing lower half oil groove 119. After lubricating the first and second journals 55 and 58, the lubricating oil is released from the first bearing lower half 53 and the second bearing lower half 56, and then flows into the thrust plate receiving groove 64 via the oil grooves 121.

The lubricating oil that has been supplied to the second bearing lower half oil groove 119 is also supplied to the plunger support hole 82 via the land oil groove 123, the cap side oil groove 124, the land oil passage 125 and the upper housing oil passage 127. The lubricating oil supplied to the plunger support hole 82 is supplied to the outer circumferential surface of the skirt 91 of the roller holder 88, and is then, via the gap between the outer circumferential surface of the skirt 91 and the inner circumferential surface of the plunger support hole 82, diverted to both the free end and the base end of the roller holder 88. The lubricating oil that has reached the free end of the roller holder 88 flows along the surface of the support legs 90 and the support shaft 92, and reaches the surface of the roller 87 under the action of the gravity and the reciprocating movement of the plunger 86 such that the cam surface of the pump drive cam 61 is favorably lubricated. The lubricating oil that has reached the base end of the roller holder 88 passes around the upper edge of the skirt 91, and drops downward via the oil holes 84 onto the roller 87. In this manner, the plunger 86 of the fuel injection pump 4 and the pump drive cam 61 are lubricated by the lubricating oil that is supplied via the oil passages formed in the exhaust camshaft 37, the lower housing 42 and the upper housing 43.

The lubricating oil that has been supplied to the roller 87 and the pump drive cam 61 drops onto the bottom surface 74 of the lower housing recess 46, and is collected in a lower part thereof. An oil drain hole 130 is formed in the lowermost part of the bottom surface 74 of the lower housing 42 and communicates with the part of the valve chamber 16 located under the lower housing 42 so that the lubricating oil that is collected in the bottom surface of the lower housing recess 46 is expelled to the valve chamber 16 via the oil drain hole 130. The cylinder head 2 and the cylinder block are formed with an oil return passage for returning the oil from the valve chamber 16 to the oil pan provided under the cylinder block. Alternatively, the oil drain hole 130 may be directly communicated with the oil return passage of the cylinder head 2, instead of being communicated with the valve chamber 16.

In the foregoing embodiment, the lower housing 42 of the fuel injection pump 4 is attached to the upwardly facing attaching surface 17 of the left peripheral wall 13, the front peripheral wall 11 and the rear peripheral wall 12 of the cylinder head 2, and overlaps with the cylinder head 2 (or the valve chamber 16) in plan view with the remaining part of the lower housing extending beyond the left end of the cylinder head 2 (and the cylinder block). The fuel injection pump 4 is subjected to a radial load from the pump drive cam 61 of the exhaust camshaft 37. By thus placing the fuel injection pump 4 (or the part thereof that is subjected to the radial load) on the cylinder head 2, the radial load can be favorably supported by the cylinder head 2 via the lower housing 42. In particular, the fuel injection pump 4 and the cylinder head 2 are favorably attached to each other so that a creation of a gap between the lower housing 42 and the cylinder head 2 can be avoided in a reliable manner.

Because the first bearing lower half 53 and the second bearing lower half 56 supporting the exhaust camshaft 37 are integrally formed with the lower housing 42 (so as to be on the cylinder head 2 in plan view), the lower housing 42 and the upper housing 43 are subjected to the loading of the pump drive cam 61 via the plunger 86 and the pump main body 40 on the one hand, and are caused to support the reaction of the plunger 86 via the pump drive cam 61, the exhaust camshaft 37, the first bearing lower 53 and the second bearing lower half 56 on the other hand. As the reaction is directed in the direction to force the lower housing 42 onto the attaching surface 17 of the cylinder head 2, the lower housing 42 is all the more firmly attached to the cylinder head 2 so that a creation of a gap between the lower housing 42 and the cylinder head 2 can be avoided in a reliable manner.

As the lower housing 42 is integrally formed with the third bearing lower half 68 supporting an end of the intake camshaft 30, the intake rocker shaft support portion 72 supporting an end of the intake rocker shaft 26 and the exhaust rocker shaft support portion 67 supporting an end of the exhaust rocker shaft 33, even though the lower housing 42 extends above the valve chamber 16 or above the cylinder head 2, the increase in the size of the cylinder head 2 can be avoided. In other words, because the lower housing 42 is essentially located inside the valve chamber 16, the need for any extra space for accommodating the lower housing 42 can be eliminated.

Furthermore, because the lower housing 42 and the upper housing 43 are interposed vertically between the cylinder head 2 and the head cover 3, and the lower blow-by gas passage 96 and the upper blow-by gas passage 97 are passed vertically through the lower housing 42 and the upper housing 43, the engine 1 can be constructed in a highly compact manner. In particular, because the lower blow-by gas passage 96 and the upper blow-by gas passage 97 are provided in a dead space defined between the intake camshaft 30 (or the intake rocker shaft 26) and the exhaust cam shaft 37 (or the exhaust rocker shaft 33) in the fore and aft direction, and between the first bearing lower half 53 and the second bearing lower half 56 in the lateral direction, the engine 1 can be constructed in a highly compact manner. Also, as the lower blow-by gas passage 96 and the upper blow-by gas passage 97 are located substantially centrally of the lower housing 42 and the upper housing 43, and abut (are joined) to the cylinder head 2, the attachment of the lower housing 42 to the cylinder head 2 may be maintained in a stable manner.

Although the present invention has been described in terms of preferred embodiments thereof, it is obvious to a person skilled in the art that various alterations and modifications are possible without departing from the scope of the present invention which is set forth in the appended claims. For instance, the auxiliary device attached to the cylinder head 2 in the foregoing embodiment consisted of a fuel injection pump, but may also consist of other engine auxiliary devices such as a water pump and an air compressor.

The contents of the original Japanese patent applications on which the Paris Convention priority claim is made for the present application as well as the contents of the prior art references mentioned in this application are incorporated in this application by reference.

The invention claimed is:

1. An auxiliary device mounting structure for an internal combustion engine, comprising:

a cylinder head defining a valve chamber in cooperation with a head cover;

a camshaft rotatably supported by the cylinder head inside the valve chamber and having a coaxial and integral extension at an axial end thereof, the extension being formed with a radial cam;

a first housing attached to the cylinder head, and defining a part of a housing chamber receiving the extension of the camshaft;

a second housing attached to the first housing and defining a remaining part of the housing chamber;

an auxiliary device supported by the second housing and provided with a plunger configured to be actuated by the radial cam of the extension; and at least two radial bearings are integrally formed on the first housing to rotatably support the extension, wherein the at least two radial bearings are located more inward than the axial end of the cylinder head, wherein a part of the extension located between the two bearings is provided with a thrust plate, the thrust plate being provided with a thrust bearing surface that cooperates with an opposing thrust bearing surface formed in a part of the first housing.

2. The auxiliary device mounting structure according to claim 1, wherein the extension includes a part that extends axially beyond an axial end of the cylinder head in the manner of a cantilever.

3. The auxiliary device mounting structure according to claim 1, wherein the opposing thrust bearing surface of the first housing is formed in a thrust plate receiving groove formed in the first housing.

4. The auxiliary device mounting structure according to claim 1, wherein the thrust plate is provided with at least one projection, and the second housing is provided with a sensor for detecting the projection.

5. The auxiliary device mounting structure according to claim 1, wherein the first housing is provided with an oil groove that conducts lubricating oil released from at least one of the at least two radial bearings.

6. The auxiliary device mounting structure according to claim 1, wherein the camshaft comprises an exhaust camshaft, and an intake camshaft is rotatably supported by the cylinder head within the valve chamber in parallel with the exhaust camshaft; and wherein the first housing is additionally provided with an additional bearing for rotatably supporting an axial end of the intake camshaft.

7. The auxiliary device mounting structure according to claim 6, wherein the first housing is provided with an extension that supports an end of a rocker shaft associated with at least one of the intake camshaft and the exhaust camshaft.

8. The auxiliary device mounting structure according to claim 1, wherein a bottom wall of the first housing is provided with an oil drain hole for returning the oil in the first housing to the valve chamber or to an oil pan.

9. The auxiliary device mounting structure according to claim 8, wherein the cylinder head includes an upper peripheral wall, and the first housing is attached to an upper face of the upper peripheral wall, and the drain hole communicates with the valve chamber.

10. An auxiliary device mounting structure for an internal combustion engine, comprising:

a cylinder head defining a valve chamber in cooperation with a head cover;

a camshaft rotatably supported by the cylinder head inside the valve chamber and having a coaxial and integral extension at an axial end thereof, the extension being formed with a radial cam;

a first housing attached to the cylinder head, and defining a part of a housing chamber receiving the extension of the camshaft;

a second housing attached to the first housing and defining a remaining part of the housing chamber;

an auxiliary device supported by the second housing and provided with a plunger configured to be actuated by the radial cam of the extension; and at least one radial bearing integrally formed on the first housing at a position located more inward than the axial end of the cylinder head to rotatably support the extension, wherein the camshaft is formed with an axial passage for conducting lubricating oil and a radial passage for supplying the lubricating oil from the axial passage to an outer circumferential surface of a journal at which the extension is supported by the at least one radial bearing, the first housing is provided with a first oil passage communicating a surface of the radial bearing supporting the journal of the camshaft extension with a surface of the first housing interfacing with the second housing, and the second housing is provided with a second oil passage communicating with the first oil passage at the interfacing surface at one end thereof and with a plunger receiving hole of the second housing slidably receiving the plunger of the auxiliary device.

11. The auxiliary device mounting structure according to claim 10, wherein an outer end of the plunger is located below a base end thereof.

12. The auxiliary device mounting structure according to claim 10, wherein the radial bearing includes a lower half integrally formed with the first housing and a bearing cap attached to the lower half, and wherein the bearing lower half is provided with a lateral extension defining a part of interface with the second housing, the first oil passage being partly formed in the lateral extension, and communicating with the second oil passage at the interface of the lateral extension.

13. The auxiliary device mounting structure according to claim 10, wherein the first oil passage includes a section extending in an interface between the bearing lower half and the corresponding bearing cap.

14. The auxiliary device mounting structure according to claim 10, wherein the plunger includes an oil passage communicating an interior of the plunger support hole with an outer end of the plunger.

15. An auxiliary device mounting structure for an internal combustion engine, comprising:

a cylinder head defining a valve chamber in cooperation with a head cover;

a camshaft rotatably supported by the cylinder head inside the valve chamber and having a coaxial and integral extension at an axial end thereof, the extension being formed with a radial cam;

a first housing attached to the cylinder head, and defining a part of a housing chamber receiving the extension of the camshaft;

a second housing attached to the first housing and defining a remaining part of the housing chamber;

an auxiliary device supported by the second housing and provided with a plunger configured to be actuated by the radial cam of the extension; and at least one radial bearing integrally formed on the first housing at a position located more inward than the axial end of the cylinder head to rotatably support the extension, further comprising a breather case defining a breather chamber in cooperation with an outer surface of the head cover, the breather chamber directly communicating with the housing chamber which in turn communicates with the valve chamber.

16. The auxiliary device mounting structure according to claim 15, wherein the head cover is formed with a blow-by gas passage that communicates the breather chamber with the housing chamber via a part thereof at an interface with the second housing.

* * * * *